United States Patent [19]

Dring

[11] Patent Number: 4,710,104

[45] Date of Patent: Dec. 1, 1987

[54] VARIABLE DISPLACEMENT FLUID PUMP WITH TRANSDUCER INTERFACE

[75] Inventor: Eric Dring, Mansfield, United Kingdom

[73] Assignee: Dale (Mansfield) Limited, England

[21] Appl. No.: 931,888

[22] Filed: Nov. 17, 1986

Related U.S. Application Data

[63] Continuation of Ser. No. 746,426, Jun. 19, 1985, abandoned.

[30] Foreign Application Priority Data

Jul. 10, 1984 [GB] United Kingdom ..... 8417539

[51] Int. Cl.[4] ..... F04B 17/00; F04B 35/00

[52] U.S. Cl. ..... 417/53; 417/342

[58] Field of Search ..... 417/342; 91/436, 401

[56] References Cited

U.S. PATENT DOCUMENTS 3,733,965 5/1973 Braun ..... 417/342 X
4,023,363 5/1977 Liebert ..... 91/401 X

FOREIGN PATENT DOCUMENTS 1019563 11/1957 Fed. Rep. of Germany ..... 417/342
1327214 4/1963 France ..... 417/342

*Primary Examiner*—Carlton R. Croyle
*Assistant Examiner*—Donald E. Stout
*Attorney, Agent, or Firm*—W. Thad Adams, III

[57] ABSTRACT

Apparatus for providing a variable supply of water under pressure to an hydraulic ring main pressure fluid circuit in, for example, a coal mine, comprises a reciprocating pump in said ring main and an hydraulic reciprocating motor for driving said pump mechanically coupled to said pump, the motor being operated by a variable displacement pump connected in a closed circuit with said motor.

3 Claims, 1 Drawing Figure

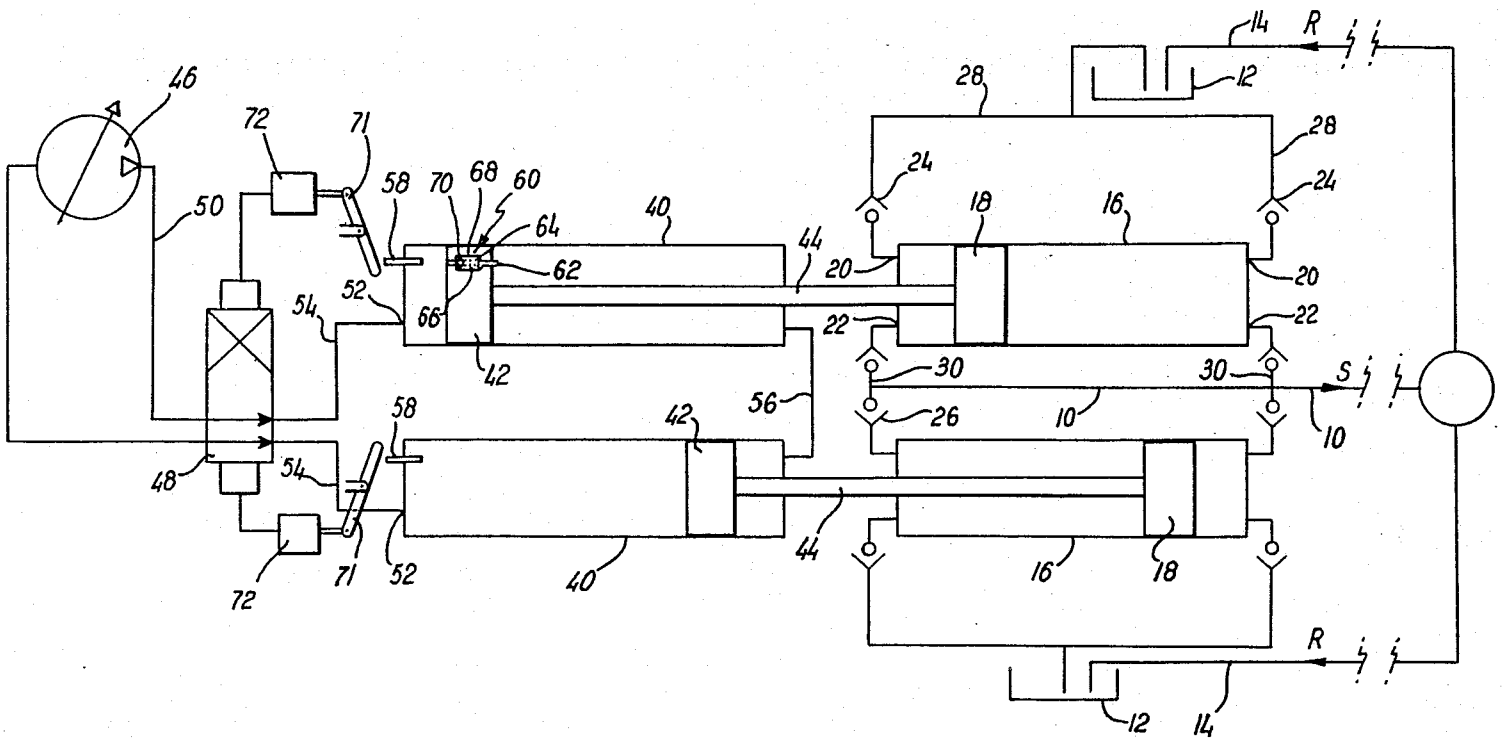
R
S
R
10
12
14
16
18
20
22
24
26
28
30
40
42
44
46
48
50
52
54
56
58
60
62
64
66
68
70
71
72

VARIABLE DISPLACEMENT FLUID PUMP WITH TRANSDUCER INTERFACE

This application is a continuation of application Ser. No. 746,426, filed 6/19/85, now abandoned.

The present invention concerns improvements in or relating to pumping arrangements, especially but not exclusively pumping arrangements for supplying hydraulic fluid under pressure to mining apparatus, for example hydraulic roof supports.

It is a common feature in present day coal mines to provide an hydraulic "ring main" from which high pressure hydraulic fluid can be tapped to supply hydraulic mine roof supports and hydraulic coal cutting and winning machines. Such existing systems are supplied by a large capacity high pressure hydraulic pump, the outlet from which includes, in addition to a connection to the hydraulic main supply pipe, a branch pipe fitted with a dump valve which is actuated in accordance with the pressure in the hydraulic main line downstream of a check valve located in said main line downstream of the branch pipe. Thus if the pressure in the main line is below a predetermined lower pressure value the dump valve is closed such that the outlet from the pump is directly connected to the main line by way of the check valve. If, however, the pressure sensing means detect a pressure above a predetermined higher pressure value it causes the dump valve to open so that fluid from the outlet of the constantly operating pump is diverted to the supply tank of the hydraulic circuit.

The pressure differential between opening and closing conditions for the dump valve must, of necessity, be relatively large to avoid hunting. This gives rise to problems. For example, when a miner is setting a roof support it is common practice for him to supply the hydraulic rams of the support with pressure fluid from the main hydraulic line simply by opening a feed valve for the rams and allowing hydraulic fluid to be supplied until he assesses that maximum pressure is being applied to the ram, that is when there is no further movement of the ram. It will be realised that if the miner carries out this operation or at least closes the valve when the dump valve is open a pressure corresponding to the lower predetermined pressure or at least a pressure below the higher predetermined pressure is supplied to the ram which is thus not at full pressure and not exerting the full design support on the roof. Clearly this can give rise to structural faulting etc.

In the past attempts have been made to overcome this problem but they have all proved to be unsatisfactory. One such attempt has been to provide a variable displacement pump but no such pump has been found which will operate in an efficient manner in the conditions normally encountered.

The non-flammable hydraulic fluid employed in mines is water-based and as a result of leakage from the main line, valves, rams, etc. it has to be topped up fairly frequently. There can be no guarantee that it is topped up with hydraulic fluid of the correct type and more often than not it is found that it is topped up with water alone. No currently available variable displacement pump of the capacity required, for example up to 50 gallons per minute at 2500 lbf/in$^2$, can pump water in view of lubrication and other problems.

It is an object of the present invention, therefore, to provide a pumping arrangement which obviates or mitigates these and other disadvantages.

According to the present invention there is provided a pumping arrangement comprising a first reciprocating pump assembly for supplying a first pressure fluid and a second assembly for driving said first assembly mechanically connected thereto, the second assembly being driven by means of a second pressure fluid.

Preferably the first assembly includes a double acting piston and cylinder device.

Preferably the second assembly comprises reciprocating motor means.

Preferably the motor means includes a further piston and cylinder device, the piston of which is directly connected to the piston of the first assembly.

Preferably in the first and second assemblies two piston and cylinder devices are arranged in parallel.

In the second assembly the cylinders on the annular sides of the piston may be interconnected and the cylinders on the other sides of the pistons are connected to a spool valve which diverts high pressure hydraulic fluid from a pump to an appropriate cylinder.

Preferably the spool valve is operated by a pilot valve which in turn is operated by a linkage actuated by abutment of the pistons of the second piston and cylinder assembly with a link of said linkage at or near the end of their strokes.

Preferably in the first and second piston and cylinder assemblies the piston of one cylinder of the assembly is arranged out of phase with the piston of the other cylinder of the assembly.

Preferably a bleed passage is provided through each piston of the second piston and cylinder assembly to permit passage of hydraulic fluid from the side of the piston connectable with the pump to the annulus of the cylinder, to make up any leakage.

An embodiment of the present invention will now be described by way of example only with reference to the accompanying hydraulic diagram.

It is an object of the present invention to provide hydraulic fluid, conveniently water, at a pressure of around 2500 lbs per square inch and at a rate of approximately 50 gallons per minute to a main hydraulic supply line 10 which supplies mining equipment (not shown), for example the hydraulic rams of roof supports, coal cutting and coal winning arrangements, which are connected to the line 10 downstream of the arrow S, hydraulic fluid from these arrangements returning to the reservoir tank 12 by way of return lines 14 through which fluid passes in the direction of the arrows R to form a hydraulic ring main 13.

Water is supplied to the main line 10 from both sides of double-acting piston and cylinder devices 16 of a first piston and cylinder assembly. The piston 18 of one device is arranged out of phase with that of the other as shown in the diagram and the cylinders are each provided with inlet ports 20 and outlet ports 22 connected by means of non-return valves 24, 26 to the supply tank 12 by lines 28 and to the main line 10 by lines 30.

It will be appreciated, therefore, that on movement of the pistons 18 in the cylinders 16 a supply of pressure hydraulic fluid be provided in the line 10.

A second reciprocating assembly is provided for moving the pistons 18. It comprises two further piston and cylinder devices 40, the pistons 42 of which are directly connected to the pistons 18 of the first assembly by piston rods 44. The pistons 42 are driven by high pressure hydraulic fluid including a soluble lubricant supplied by a variable displacement pump, for example a swash-plate pump 46, by way of a pilot-operated spool valve 48. High pressure fluid from the pump 46 is led by way of a line 50 to the spool valve 48 and is thereby directed to the inlet/outlet port 52 of one or other of the cylinders 40 by way of a supply/exhaust line 54. A connection 56 extends between the annulus sides of the cylinders 40 and it will be realised that when pressure fluid from the pump 46 is fed to the first side of the upper cylinder 40 (as viewed in the diagram) the piston 42 will be caused to move down the cylinder thereby ejecting the piston rod 44 and causing fluid from behind the piston to pass by way of the line 56 into the annulus side of the lower cylinder, this causing the piston 42 to move up its cylinder, hydraulic fluid in front of the piston 42 passing by way of the spool valve 48 to the inlet to the pump 46.

The pilot-operated spool valve 48 is actuated in accordance with the position of the pistons 42 and a mechanical linkage which is not illustrated in the diagram is utilised for this purpose. Each cylinder 40 is provided at its upper end with a push rod 58 slidably mounted in the cylinder head and which is moved out of the cylinder as the piston 42 reaches the end of its stroke. Movement of the push rod 58 causes movement of the linkage 71 and in turn actuates the pilot valve 72 of the spool valve 48, this pilot valve 72 in turn changing the direction of feed of pressure fluid from the spool valve from one cylinder to the other.

To accommodate for any losses in hydraulic fluid in the closed circuit comprising the pump 46 the spool valve 48 and the two cylinders 40 a bleed passage 60 is provided through each piston 42, only one being shown in the diagram. The bleed passage comprises a spring-urged poppet valve 62 projecting from the annular side of the piston and being urged against its seat 64 by a spring 66 accommodated in a chamber 68 in the piston, the chamber 68 including also a non-return valve 70. It will be realised therefore that as the piston 42 reaches the end of its stroke the stem of the poppet valve 62 will abut the base of the cylinder and will lift it off its seat so that pressure fluid from the other side of the piston may pass through the passage 68 to make up for any losses on the downstream side of the pistons.

It will be realised therefore that the closed-circuit referred to above can operate with a relatively expensive hydraulic fluid which enables the use of a variable displacement pump or pumps 46 of sufficient rating without any of the problems normally encountered with pumps of this nature when fluid having low lubricating properties is utilised. There is no need to use this relatively expensive fluid which is difficult to maintain at its best operating quality in the first piston and cylinder assembly so that, as stated above, it can operate utilising water as its pressure fluid.

Pressure sensing means (not shown) are provided in the variable displacement pump 46 and if a reduction in pressure in the pump output is detected the pump automatically corrects this itself. The output pressure of the pump 46 is controlled at such a value that the equivalent pressure developed by the piston and cylinder assemblies 16 is the 2500 $lbf/in^2$ required on the coal face. The pump output pressure selected depends on the bore diameters of the cylinders 16 and 40.

In a first modification of the arrangement, which is not illustrated in the diagram, the hydraulic fluid pumped by the pump 46 can be cooled by use of a heat exchanger, the secondary fluid of which is water from the supply or return lines 10, 14 of the hydraulic ring main 13.

Various other modifications can be made without departing from the scope of the invention, for example alternative spool valves, alternative means for operating the spool valve, more than two piston and cylinder devices in each assembly can be employed. The second piston and cylinder devices could be replaced by any other motor means driven by hydraulic fluid and causing reciprocatory movement of the pistons of the first assembly.

I claim:

1. A mine pumping apparatus for providing a relatively constant pressure supply of a water-based fluid for use in powering hydraulic machines utilized in mining operations comprising:

(a) a pump assembly for supplying a first pressure fluid to a ring main of the mine to power hydraulically operated machines connected to said ring main and comprising a first pair of double acting piston and cylinder devices arranged to operate in opposite phase;

(b) a motor assembly for driving said pump assembly mechanically connected thereto and comprising a second pair of piston and cylinder devices, mechanical connection means for connecting each piston of the motor assembly directly to one piston of the pump assembly and fluid connection means for interconnecting the cylinder behind the respective one piston of the motor assembly to the cylinder behind the respective other piston of the motor assembly;

(c) a variable displacement pump for supplying a second pressure fluid alternately to the cylinders in front of the pistons of the motor assembly;

(d) fluid lines for conveying fluid between said cylinders of the motor assembly and the variable displacement pump; and (e) valve means in said fluid lines for controlling the supply and exhaust of said second pressure fluid alternately to and from the cylinders of said motor assembly whereby said second hydraulic fluid pressurized by said variable displacement pump is utilized to provide pressure to the first pressure fluid in the ring main, which first pressurized fluid is utilized to power hydraulically operated machinery connected to the ring main.

2. A mine pumping apparatus as claimed in claim 1 in which the valve means comprises:

(a) a spool valve;

(b) a pilot valve for actuating the spool valve; and (c) a linkage between the pilot valve and said motor assembly actuated by abutment of the pistons of the motor assembly with a link of said linkage at or near the end of their respective strokes.

3. A method of providing a variable supply of a water-based fluid at constant pressure to a hydraulic ring main in a mine to which hydraulically operated machines are connected comprising the steps of:

(a) actuating out-of-phase a pair of double acting piston and cylinder pumps interposed in said hydraulic ring main to maintain a constant pressure level in a first pressure fluid therein for hydraulically operating machines connected thereto;

(b) driving said double acting piston and cylinder pumps by use of a pair of out-of-phase piston and cylinder hydraulic motors, the piston of each of said motors being mechanically connected to the piston of a corresponding pump;

(c) supplying a second pressure fluid from a variable displacement pump to the cylinders of the motors in front of their pistons;

(d) permitting a flow of said first pressure fluid between the rear of the pistons of the motor; and (e) controlling the flow of said second pressure fluid from the variable displacement pump to the motors by means of a spool valve to supply and exhaust the motor cylinders alternately.

* * * * *